US009384723B2

(12) United States Patent
Ayres

(10) Patent No.: US 9,384,723 B2
(45) Date of Patent: Jul. 5, 2016

(54) METHOD OF RETRIEVING PROCESSING PROPERTIES AND AUDIO PROCESSING SYSTEM

(71) Applicant: Harman International Industries, Ltd., Potters Bar Hertfordshire (GB)

(72) Inventor: Richard Ayres, Stevenage (GB)

(73) Assignee: Harman International Industries Limited, Potters Bar Hertfordshire (GB)

( * ) Notice: Subject to any disclaimer, the term of this patent is extended or adjusted under 35 U.S.C. 154(b) by 186 days.

(21) Appl. No.: 14/190,822

(22) Filed: Feb. 26, 2014

(65) Prior Publication Data

US 2014/0241538 A1 Aug. 28, 2014

(30) Foreign Application Priority Data

Feb. 26, 2013 (EP) ..... 13156665

(51) Int. Cl.

| | |
|---|---|
| ***G10H 7/00*** | (2006.01) |
| ***G10H 1/00*** | (2006.01) |
| ***H04R 27/00*** | (2006.01) |
| ***H04H 60/04*** | (2008.01) |
| *H04S 7/00* | (2006.01) |

(52) U.S. Cl.

CPC ..... *G10H 7/00* (2013.01); *G10H 1/0008* (2013.01); *H04H 60/04* (2013.01); *H04R 27/00* (2013.01); *G10H 2210/056* (2013.01); *G10H 2210/155* (2013.01); *H04S 7/30* (2013.01); *H04S 2400/15* (2013.01); *H04S 2420/03* (2013.01)

(58) Field of Classification Search

None

See application file for complete search history.

(56) References Cited

U.S. PATENT DOCUMENTS

| | | | | |
|---|---|---|---|---|
| 2002/0007717 | A1* | 1/2002 | Uehara | G10H 1/0008 84/600 |
| 2011/0025916 | A1 | 2/2011 | Kohara et al. | |
| 2011/0033061 | A1 | 2/2011 | Sakurada et al. | |
| 2012/0294457 | A1 | 11/2012 | Chapman et al. | |
| 2013/0003981 | A1 | 1/2013 | Lane | |

OTHER PUBLICATIONS

Extended European Search Report for corresponding Application No. EP 13156665.5, mailed Nov. 11, 2013, 7 pages.

* cited by examiner

*Primary Examiner* — Paul Huber

(74) *Attorney, Agent, or Firm* — Brooks Kushman P.C.

(57) ABSTRACT

Techniques for storing and retrieving processing properties for processing an audio signal in an audio processing system, such as, an audio mixing console are provided. The processing properties specify audio effects and/or audio mixing applied to the audio signal. Type information is established which relates to audio content properties of the audio signal. The type information allows classifying audio signals based on their audio content. Based on the type information, processing parameters are stored in a database and/or retrieved from the database.

20 Claims, 7 Drawing Sheets

METHOD OF RETRIEVING PROCESSING PROPERTIES AND AUDIO PROCESSING SYSTEM

CROSS-REFERENCE TO RELATED APPLICATIONS

This application claims priority to EP Application No. 13 156 665.5, filed Feb. 26, 2013, the disclosure of which is incorporated in its entirety by reference herein.

TECHNICAL FIELD

Various embodiments relate to a method of retrieving processing properties for processing of an audio signal. The processing properties specifying audio effects and/or audio mixing applied to the audio signal when processing the audio signal, and to an audio processing system.

BACKGROUND

Audio processing systems, for example, audio mixing consoles or software-based solutions, are known which are portable and can be releasably connected with external equipment. For example, external equipment may be microphones, audio sources such as Compact Disc (CD) player, external amplifiers, electronic music instruments, etc.

When connecting the external equipment to the audio processing system, processing properties may need to be set which specify audio effects and/or audio mixing applied to the audio signal when processing the audio signal. The processing properties may be set using a user interface.

In order to handle a plurality of external equipment, a plurality of audio inputs may exist at the audio processing system. For each audio input, there may be one or more user interfaces allocated. The setting of the one or more user interfaces may set the audio processing properties of the respective audio signal. This may define a signal path of the audio signal within the audio processing system comprising the audio processing as set by the user interfaces; the signal path is sometimes referred to as an audio channel.

The allocation or routing between user interfaces on the one side and the audio inputs on the other sides is sometimes referred to as a patch. Re-patching may refer to changing the allocation between the audio inputs and the user interfaces (i.e., to changing the association between a given audio channel and a given user interface).

Sometimes the allocation between user interfaces and audio inputs is fixed (i.e., may not be changed by user of the audio processing system) or re-patching may not be possible. However, for example, in the field of digital processing systems, it is known to provide a freely configurable allocation between user interfaces and audio inputs; where, in other words, re-patching is possible.

For example, a position of the audio inputs on the audio processing system may be remote or at a certain distance with respect to the user interfaces such that there is no well-defined patch inherently given by a positioning of audio inputs versis user interfaces. It may, moreover, not be required in such systems that at any given point in time all, audio signals received by an audio input have a respectively allocated user interface. For example, different criterions for grouping of user interfaces in layers or banks can be applied, different to a physical location of the audio inputs.

Scenarios are likely to occur where one and the same external equipment is connected to the audio processing system in a plurality of subsequent occasions or sessions.

Between two subsequent occasions, the external equipment is often disconnected, for example, for storage and/or transportation purposes. A particular user interface may keep its setting such that corresponding audio properties may not need to be set anew for every occasion.

In such scenarios, known systems often provide the advantage of flexibility and scalability of the allocation between audio inputs versus user interfaces. On the other hand, they may face certain restrictions. For example, in a scenario where frequent re-connecting of external equipment occurs, it may be difficult for a user to remember the allocation between user inputs on the one side and user interfaces setting the processing properties of audio processing channels on the other side. In particular, connecting every external equipment to exactly the same audio input may be cumbersome and may be subject to undetected errors. On the other hand, it may require significant time to change or modify the allocation between the various audio inputs and the user interfaces setting the audio processing of the audio processing channels (i.e., to re-patch).

Therefore, a need exists to provide techniques which allow for a flexible, fast and simple re-connection and setup of a set of external equipment to an audio processing system at subsequent occasions.

SUMMARY

This need is met by the features of the independent claims. The dependent claims define embodiments.

According to one aspect, a method of retrieving processing properties for processing of an audio signal in an audio processing system is provided. The processing properties specify audio effects and/or audio mixing applied to the audio signal when processing the audio signal. The method comprises, at an audio input of the audio processing system, receiving the audio signal and establishing type information for the received audio signal. The type information relates to audio content properties of the audio signal. The method further comprises, depending on the established type information, retrieving the processing properties for the audio signal from a database of processing properties. The database associates type information with processing properties.

For example, the audio processing system may be an audio mixing console, for example, a digital audio mixing console or a computer implemented and software-based audio mixing console. The processing properties may specify an audio processing channel of the audio processing system. In other words, the method may comprise selecting an audio processing channel of the audio processing system based on the established type information, the audio processing channel processing audio signals using respective processing properties; the method may further comprise routing of the audio signal to the selected audio processing channel.

The audio effects may be selected from the group comprising: volume; equalizer setting; echo; fade; playback speed; timbre; tone color; tone quality and distortion.

Audio mixing may relate to mixing the audio signal with a further audio signal. The further audio signal may be received from a further audio input or may be generated or established otherwise.

Various audio effects which may be applied to the audio signal when processing the latter and various audio mixing techniques are conceivable and in general known to the skilled person. Therefore, there is no need to discuss further details of the audio effects and for the audio mixing in this context.

The audio input may be a digital audio input or an analogue audio input. Various technical standards are known for audio inputs and the audio signal which may be readily applied in the present case. Audio content, such as for example, classical music, female or male vocal, electric guitar—of the audio signal may be predominantly independent of the particular data format for example, G.711 using Pulse Code Modulation (PCM) as defined by the International Telecommunication Union (ITU), or other data formats used for the audio signal. The audio signal may be received from external equipment.

The audio content properties may refer to a classification or type associated with the audio content of the audio signal. Different classifications of the audio content may be used and are not particularly limited. Non-limiting examples may be: voice, orchestra, speech, electric sound, pop, classical music, guitar, keyboard, piano, music instruments, and so forth.

In various scenarios, establishing the type information may refer to determining the type information using a processor of the audio processing system or receiving the type information from an external unit or a combination thereof.

Said establishing of the type information and/or said retrieving of the processing properties may be executed in an automatic manner and/or a semi-automatic manner (i.e., with no or little user interaction). However, it may be possible to prompt for user interaction in cases where the establishing is not possible or only possibly with a high degree of uncertainty. Then a user may manually select the type information as part of the establishing.

For example, difficulties in said establishing of the type information may occur if there is excessive background noise present in the audio signal. Recognizing audio content, for example, signal type in audio signature or spoken instructions may be comparably unreliable. Furthermore, various sound originators may have an audio content which is very much alike (i.e., mimic the sounds of each other to a large degree). For example, this may be the case for keyboards and synthesizers. Furthermore, general problems as known in the field of sound and speech recognition may reduce a quality of the establishing of the type information: changing persons, interference by picking up sound using various audio sources, unusual sounds, language, words and dialects are examples.

By retrieving from the database, the processing properties in dependence of the established type information, an effect may be achieved where the processing properties relied upon when processing the audio signal match the audio content of the audio signal. This may refer to the processing properties being well-suited for the audio content of the audio signal. In other words: it may be possible to process the audio signal using the desired processing properties independent of the particular choice of the audio input. This may give a user the flexibility of connecting the audio source of the audio signal to any available audio input. The processing properties may be retrieved independently of the particular audio input. A required time to set-up the audio processing system may therefore be reduced. Automatic application of favorite or preset processing properties to the received audio signal with a given audio content may be possible. Error during patching may be avoided.

Said establishing of the type information may depend on characterizing a sound spectrum of the received audio signal. The sound spectrum may relate to a representation of the audio signal in frequency space (i.e., resolve various spectral contributions of the audio signal). The sound spectrum of the received audio signal may be characteristic for the audio content of the audio signal. For example, different audio contents may have different sound spectra. For example, the sound spectrum of a female vocal may be different to the sound spectrum of an electric guitar, and so forth.

In various scenarios the method of the present aspect may further comprise determining the sound spectrum of the received audio signal and/or characterizing the determined sound spectrum.

Said establishing of the type information may comprise, at a processor of the audio processing system, determining a characterization of a sound spectrum of the received audio signal. The method may further comprise comparing the determined characterization of the sound spectrum with previously determined characterizations of sound spectra of previously received audio signals. The method may further comprise, in dependence of said comparing, determining the type information.

For example, said comparing of the determined characterization of the sound spectrum may take place at the processor of the audio processing system or at an external unit. Likewise, said determining of the type information may take place at the processor of the audio processing system or at an external unit. For example, if said determining of the type information takes place in an external unit, the method may further comprise sending said determined characterization of the sound spectrum to the external unit for said comparing. For example, said comparing may comprise determining a degree of a correlation between the characterization of the sound spectrum of the audio signal and the sound spectrum of the previously received audio signals. If the degree of the correlation between any two given characterizations is comparably high, it may be possible to assume that audio content properties of the associated audio signals correspond to each other. It may be possible to determine the type information of the audio signal in correspondence with the type information of the previously received audio signal which is obtained from said comparing.

The specific information provided by the type information is not particularly limited. In various scenarios, different kinds of information may be included in the type information. Various levels of abstraction may be used in an implementation of the type information. For example, the type information may include explicit information, parameterized information, links to other information, etc.

For example, the established type information may include at least one of the following: a classification of an originator of the received audio signal; an identification of an audio source of the received audio signal; a link to a previously received audio signal; a link to previously used processing properties; a link to reference audio content properties; and a characterization of a sound spectrum of the received audio signal.

For example, the originator of the audio signal may relate to a person or the equipment generating or emitting a physical sound wave. For example, the originator may be a female person, a male person, a male choir, a female choir, and/or a musical instrument, etc.

The audio source may relate to the technical equipment used to measure the physical sound wave emitted by the person or the equipment. For example, the audio source may be a microphone, a CD player, and/or an amplifier, etc.

The identification of the audio source may relate to a label and/or unique identifier and/or name of the audio source.

For example, the method may further comprise receiving audio source information identifying an audio source of the received audio signal, wherein said establishing of the type information depends on the received audio source information. For example, when the audio signal is received via a digital audio input, it may be possible to transmit the audio source information along with the audio signal, e.g., as metadata. For example, the audio source information may comprise an identifier of a classification of the particular audio source which provides the audio signal. In such a manner, it may be possible to retrieve one and the same processing properties for one and the same audio source every time this particular audio source is connected to the audio input.

For example, said characterization of the sound spectrum may comprise a spectral distribution of power of the audio signal (frequency spectrum). Said characterization of the sound spectrum may alternatively or additionally comprise a value relating to a beats per minute value. Said characterization may also comprise a minimum value indicating a minimum frequency of the frequency spectrum, a maximum frequency indicating a maximum frequency of the frequency spectrum, or other characteristic numbers of the frequency spectrum.

Said establishing of the type information may comprise extracting at least one track from the received audio signal. The method may further comprise sending the extracted track to a remote server via an interface. The remote server may be configured to characterize a sound spectrum of the track and to determine the type information in dependence of the characterized sound spectrum. The method may further comprise receiving the type information via the interface from the remote server.

The extracted at least one track may be a fraction or snapshot limited in time of the audio signal. It may, in general, have a coding format different to the one of the received audio signal. The track may be used, in other words, as a characteristic fingerprint of the entire audio signal allowing for the type information being determined.

For example, said sending may occur via the Internet. The interface of the audio processing system may be configured to provide a connection to the Internet. By using the track for said establishing, it may be possible to reduce an amount of data which has to be sent and received.

For example, if the type information includes a link to previously used processing properties or a previously received audio signal, for which processing properties may as well be available, it may be readily possible to retrieve the processing properties from the database. However, in various scenarios the type information may comprise more general information, (e.g., the classification of the originator or the identification of the audio source). Then additional steps may be necessary.

Said retrieving of the processing properties may include matching the established type information with matched type information included of in set of previously determined type information. The method may further comprise, for the matched type information, retrieving from the database associated processing properties as the processing properties for the audio signal.

For example, if the type information includes a characterization of a sound spectrum of the received audio signal, said matching may comprise comparing this characterization of the sound spectrum of the received audio signal with sound spectra of further audio signals. Likewise, if the type information includes a classification of the originator of the received audio signal, said matching may comprise finding a classification of a further audio signal which compares well with the classification of the received audio signal, In general, said matching may comprise finding a maximized level of correlation between the established type information and the matched type information included in the set of previously determined type information.

The set of previously determined type information may comprise type information relating to audio signals previously received via an interface of the audio processing system and/or predetermined reference type information.

For example, the predetermined reference type information may be type information provided by a manufacturer or a third party. For example, for the predetermined reference type information, predetermined processing parameters may be provided. Such predetermined processing parameters may be suited well for processing audio signals containing audio content associated with the predetermined reference type information.

For the reference type information, the database may comprise reference processing properties. The reference processing properties may be predefined, for example, by a manufacturer or other users or third parties.

A self-guided and automatic set-up of the audio mixing console based on the reference type information may be possible. This may be in particular of value for such users which have only little experience in the art of sound processing.

The method may further comprise detecting a speech input of a user and recognizing a user command from the speech input using speech recognition techniques. Said establishing of the type information may depend on said recognized user command.

By such means, it may be possible to establish the type information based on the recognized user command and alternatively or additionally based on further criterions, for example, a classification of the originator, identification of the audio source, a characterization of the sound spectrum of the received audio signal, and so forth.

Said detecting of the speech input and said recognizing may be selectively executed if said establishing of the type information based on a automatic characterization of the audio content of the audio signal fails.

The method may further comprise, in response to said retrieving of the processing properties, allocating at least one user interface of a plurality of user interfaces of the audio processing system for processing of the received audio signal. The method may further comprise processing the received audio signal using the retrieved processing properties and in dependence of a setting of the at least one allocated user interface.

By such techniques, a simplified and flexible setup of connection between the audio inputs of the audio processing system and external audio sources may be provided. In particular, it may be possible to re-use previously determined processing properties for a particular audio signal, while, at the same time, it may be expendable to connect the audio source of that particular audio system every time to one and the same audio input. Rather, by establishing the type information which relates to the audio content properties of the audio signal, it may be possible to retrieve the processing properties every time the audio source of the audio signal is connected to the audio input. This is because the audio content properties of the audio signal typically do not change between different times of connection of the audio source of the audio signal to the audio input.

The method may further comprise displaying, on a display of the audio processing system, a label corresponding to the determined type information, wherein the display designates the allocated at least one user interface.

For example, in a scenario where there is a plurality of user interfaces available for a plurality of audio processing channels, such techniques may allow a user to easily identify a particular user interface which is allocated for the processing of the received audio signal.

The effect of a simple perception of the allocation between audio inputs and user interfaces may be achieved.

Said retrieving of the processing properties may be selectively executed if the audio processing system is operated in a configuration mode. The configuration mode may be activated upon at least one of the following: user input; a predetermined repetition time; and detecting a change in the in the established type information during processing of the audio signal.

For example, once the setup and connection between the external audio source and the audio inputs of the audio processing system has been completed, it may be desirable not to change the processing parameters for the audio signal any more. In such a case, selectively executing the retrieving of the processing parameters in the configuration mode may have the effect that the user is in full control of the automatic re-patching provided by said retrieving the processing properties. However, it should be understood that in certain scenarios it may be desirable to continuously detect the changes in the established type information, i.e. monitor the established type information over the course of time, in order to retrieve fitting processing parameters once the change in the established type information has been detected. For example, an automatic or semi-automatic control of the audio processing system during a performance may be possible.

According to a further aspect, a method of generating a database of processing properties for processing of an audio signal in an audio processing system is provided. The processing properties specify audio effects and/or audio mixing applied to the audio signal when processing the audio signal. The method comprises, at an audio input of the audio processing system, receiving an audio signal. The method further comprises processing the audio signal using processing properties which are depending on a setting of at least one user interface of the audio processing system. The method further comprises establishing type information for the received audio signal, wherein the type information relates to audio content properties of the audio signal. The method further comprises storing the processing properties and the type information in the database.

For example, the database may comprise entries of the processing properties and separate entries of the type information and may additionally store associations between the entries of type information and processing properties. However, it is also possible that the database is only structured with respect to the processing properties (type information) and the corresponding type information (processing properties) is (are) fixedly linked with each entry. Different database structures are possible and are in general known by the skilled person so that there is no need to discuss further details in this context.

For example, once the type information is established, the database may be accessed in order to retrieve the processing properties which are associated with this established type information. However, there may be cases, where there are no processing properties associated with the particular established type information. In such a case, it may be possible to retrieve processing properties which are associated with further type information which has a comparably high degree of correspondence with the established type information.

In general, the database may be provided as part of the audio processing system, for example stored on an internal memory thereof. However, it should be noted that it is also possible that the database is a centrally stored database, for example on an external server, and therefore may be accessed through a respective interface connecting to the external server.

The processing properties included in the database may be one of the following: historic user processing properties, favorite user processing properties, third-party processing properties, processing properties retrieved via an interface, preset processing properties.

The method of generating the database may be seen as providing an analyzing of the content properties of the audio signal and then storing the processing properties, possibly together with the type information including the content properties in the database. By such means, it may be possible to later on retrieve the processing properties for further use. In particular, it may be possible to retrieve the processing properties in a scenario where at a later point in time a similar audio signal is received in the sense that the audio content properties match or match to a comparably high degree of correspondence.

In particular, it may be possible to employ the data base generated by the method of the presently discussed aspect in the method of retrieving processing properties according to a further aspect of the present application.

Effects, which may be achieved with the method of generating the database according to the presently discussed aspect may be comparable to effects achieved with further aspects of the present invention.

According to a further aspect, an audio processing system is provided which comprises an audio input being configured for receiving an audio signal. The audio processing system further comprises a processor which is configured for establishing type information for the received audio signal, the type information relating to audio content properties of the audio signal. The processor is further configured for retrieving processing properties for the audio signal from a database of processing properties, depending on the type information, wherein the database associates type information with processing properties. The processing parameters specify audio effects and/or audio mixing applied to the audio signal when processing the audio signal in the audio processing system.

For example, the audio processing system may be configured to execute the method of retrieving processing properties according to a further aspect and/or the method of generating a data base according to yet another aspect of the present invention.

For such an audio processing system, effects may be achieved which are comparable to effects which may be achieved with further aspects of the present invention.

It is to be understood that the features mentioned above and features yet to be explained below can be used not only in the respective combinations indicated, but also in other combinations or in isolation, without departing from the scope of the present invention. Features of the above-mentioned aspects and embodiments may be combined with each other in other embodiments. For example, features discussed with respect to the aspect providing the method of retrieving processing properties may be readily applied to the aspect relating to the method of generating the database of processing properties and vice versa.

BRIEF DESCRIPTION OF THE DRAWINGS

In the following, the invention will be explained in further detail with respect to embodiments illustrated in the accompanying drawings.

DETAILED DESCRIPTION

Figure 1:
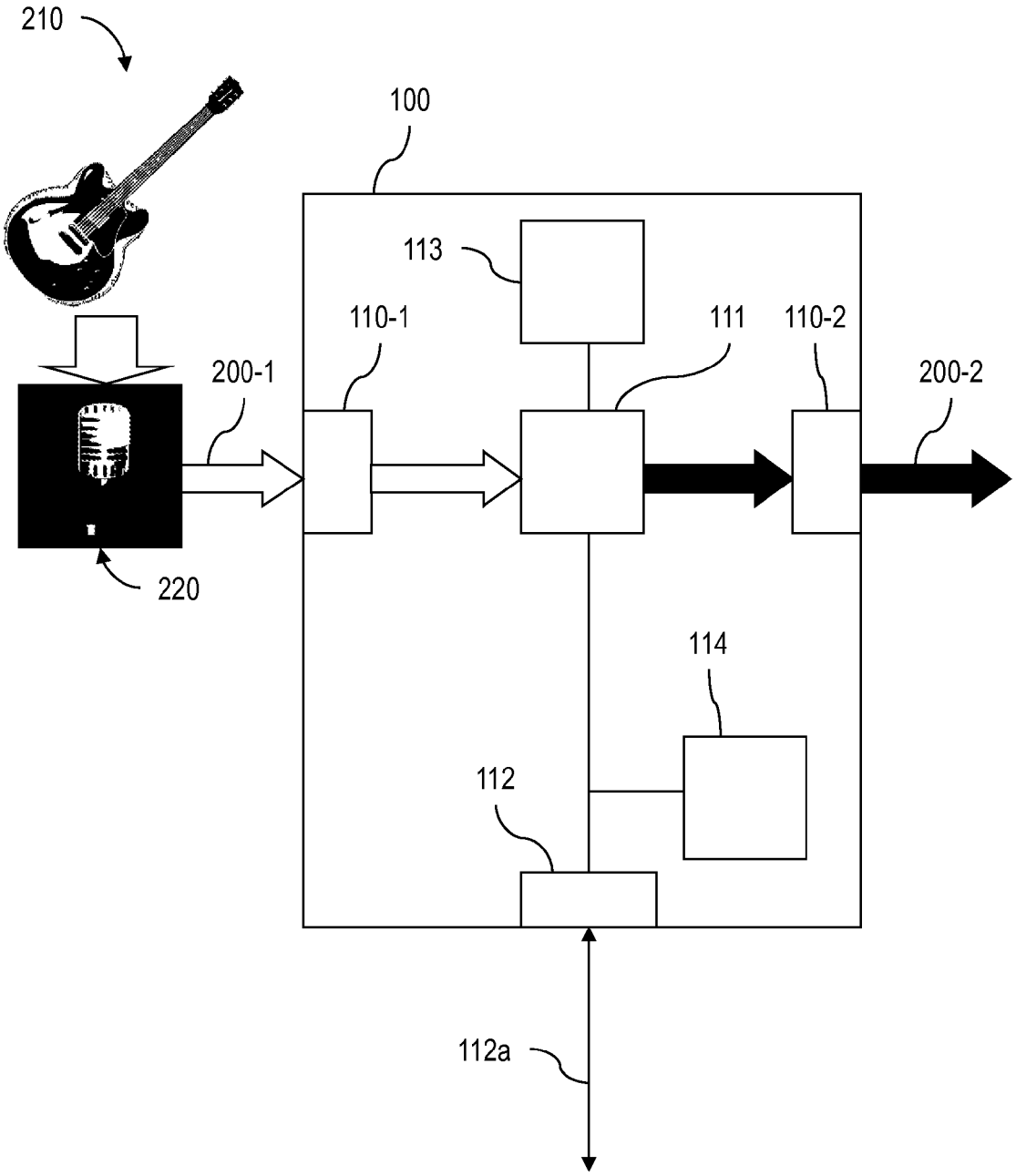
FIG. 1 is a schematic illustration of an audio processing system according to various embodiments of the present invention.

In the following, embodiments of the invention will be described in detail with reference to the accompanying drawings. It is to be understood that the following description of embodiments is not to be taken in a limiting sense. The scope of the invention is not intended to be limited by the embodiments described hereinafter or by the drawings, which are taken to be illustrative only.

The drawings are to be regarded as being schematic representations, and elements illustrated in the drawings are not necessarily shown to scale. Rather, the various elements are represented such that their function and general purpose become apparent to a person skilled in the art. Any connection or coupling between functional blocks, devices, components or other physical or functional units shown in the drawings or described herein may also be implemented by an indirect connection or coupling. A coupling between components may also be established over a wireless connection. Functional blocks may be implemented in hardware, firmware, software or a combination thereof.

In the following, the invention will be explained in more detail by referring to exemplary embodiments and to the accompanying drawings. The illustrated embodiments relate to techniques for storing and retrieving processing properties specifying audio effects and/or audio mixing applied to an audio signal when processing the audio signal using an audio processing system. By such techniques, it may be possible to use predetermined, historic, favorite, and/or preset processing properties for audio signals depending on audio content properties of the audio signal.

In particular, it may be possible to execute such techniques in an automatic manner or a semi-automatic manner. With no or only little user intervention, it may be possible to establish type information relating to the audio content properties and, in response thereto, retrieve well-suited processing properties.

In FIG. 1, an audio processing system in the form of an audio mixing console 100 is schematically illustrated. Physical sound waves originate from an originator, in the case of FIG. 1 an electrical guitar 210, and are measured by an audio source, here a microphone 220. The microphone 220 is connected to an audio input 110 of the audio mixing console 100. Via this wireless or wired connection, the audio mixing console 100 receives an audio signal 200-1 at the audio input 110-1. At a processor 111, the audio signal 200-1 is processed in order to obtain a processed audio signal 200-2 (depicted using full arrows in FIG. 1). For the processing, the processor 111 of the audio mixing console 100 uses processing properties which specify audio effects and/or audio mixing applied to the audio signal. For example, these processing properties may specify a volume, an echo, a fade, dynamics, and tone color applied to the audio signal 200-1 when processing the latter. The audio mixing may relate to mixing the audio signal 200-1 with further audio signals (not shown in FIG. 1). The processed audio signal 200-2 may be output via a further interface 110-2 of the audio mixing console 100, for example, for playback or recording. In general, techniques of processing audio signals are known to the skilled person so that there is no need to explain further details in this context.

In general, there are different possibilities and scenarios how the processing properties used for the processing of the audio signal 200-1 by the processor 111 are obtained. For example, the processing properties may be determined based on a user input received via a user interface 114. Namely, audio mixing consoles such as the audio mixing console 100 as depicted in FIG. 1 typically comprise a number of user interfaces 114 such as faders, motorized faders, rotary knobs, push buttons, displays, voice recognition, etc. A particular setting of such a user interface 114 may determine the processing properties which are used for the processing of the audio signal 200-1. Alternatively or additionally, parts of, or the entire processing properties may be retrieved via an interface 112 which is connected to the internet 112*a*.

It is also possible that the processing properties are retrieved from a database stored on a memory 113 of the audio mixing console 100. The memory 113 may be a flash memory, a hard disk drive, a cloud memory, USB connected memory, etc.

Hereinafter, techniques will be explained which allow to retrieve the processing properties in dependence of the audio signal 200-1; more particular, in dependence of audio content properties auf the audio signal 200-1. This allows to retrieve such processing parameters which are well-suited for said processing of the particular audio signal 200-1, i.e., correspond to historic processing properties used for similar audio signal of the same kind as the audio signal 200-1.

Figure 2:
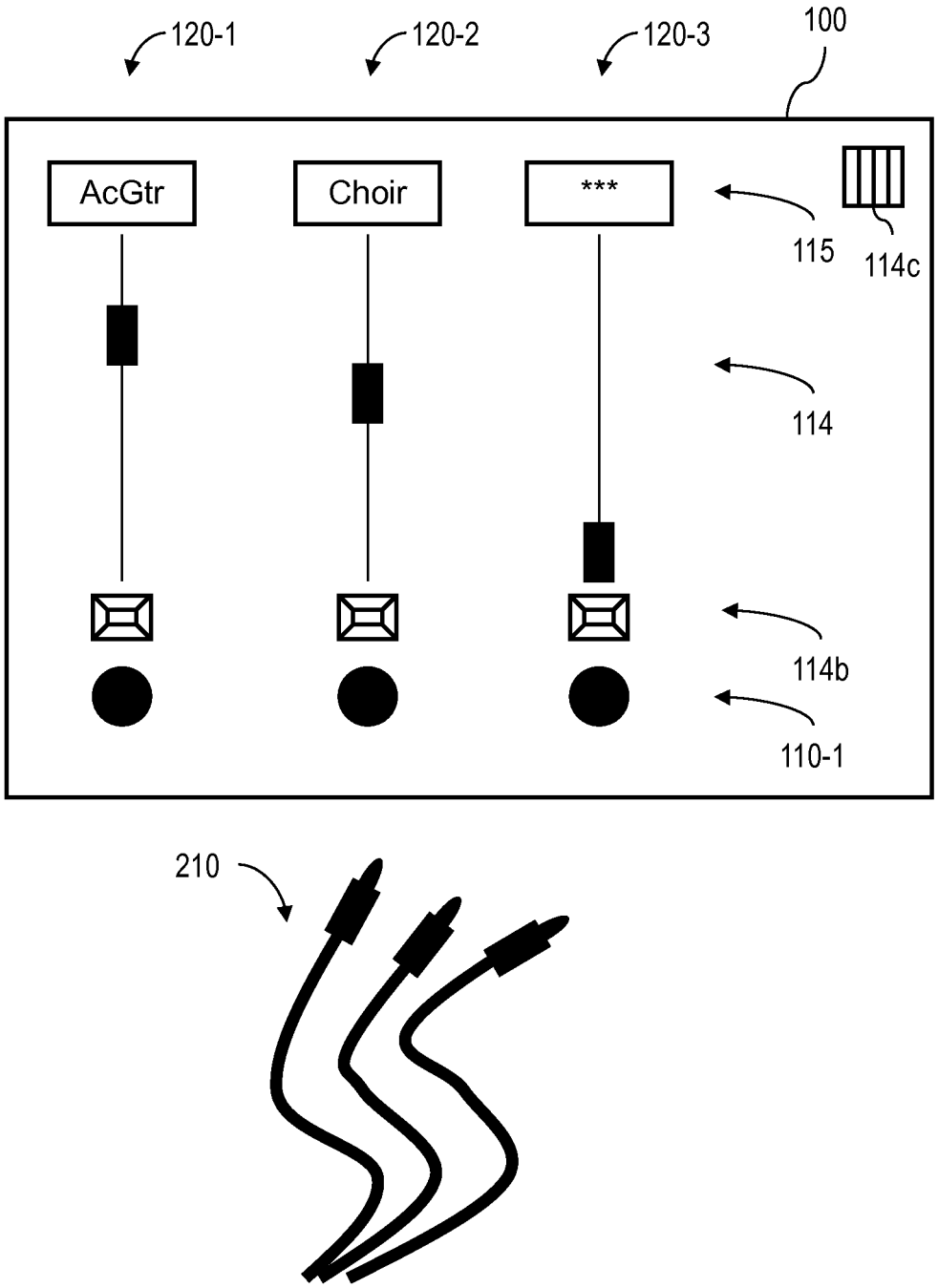
FIG. 2 is a top view of an audio mixing console.

In FIG. 2, a schematic top view of the mixing console 100 of FIG. 1 is shown. The audio mixing console 100 comprises three user interfaces 114 in the form of sliding bars. Furthermore, buttons 114*b* are arranged in the vicinity of each sliding bar 114. A microphone 114*c* is provided. Moreover, three audio inputs 110-1 in the form of sockets are provided next to each of the sliding bars 114. Furthermore, displays 115 are provided. In the scenario as shown in FIG. 2, two of the displays 115 display a label indicating an acoustic guitar and a choir.

In FIG. 2 it is shown that three plug connectors of audio sources 210 are to be connected to the audio inputs 110-1. Depending on which connector is connected to which audio input 110-1, different user interfaces 114 and displays 115 will be associated with different audio sources 210.

It should be understood that, in general, the audio inputs 110-1 do not need to be arranged in close proximity to the user interfaces 114 and/or the displays 115. Rather, typical audio mixing consoles 100 may provide the audio interfaces 110-1 at a position remote from these units 114, 115. In such a case it may be even more difficult for a user to obtain a correct patching between the different audio sources 210 and the various user interfaces 114.

The combination of user interfaces 114 and audio input 110-1 may be referred to as an audio channel 120-1, 120-2, 120-3. Audio signals present on the different channels 120-1, 120-2, 120-3 may be processed by the processor 111 using different processing properties. The processing properties may in particular be at least partially dependent on a setting of the user interfaces 114.

In the following, techniques will be explained which allow a fast, flexible, user-friendly, semi-automatic or automatic patching between the different audio sources 210 connected to the various audio inputs 110-1 and the respectively allocated user interfaces 114 and displays 115.

A scenario is considered where the connector providing the audio signal 200-1 obtained from the microphone 220 (cf. FIG. 1) is connected to the audio input 110-1, which is arranged on the right-hand side of the audio mixing console 100 as depicted in FIG. 2, (i.e., belongs to channel 120-3). In order to retrieve the processing parameters which have been previously used for processing this audio signal 200-1 obtained from the microphone 220 and containing the sound signal of the electric guitar 210, type information is established.

Figure 3A:
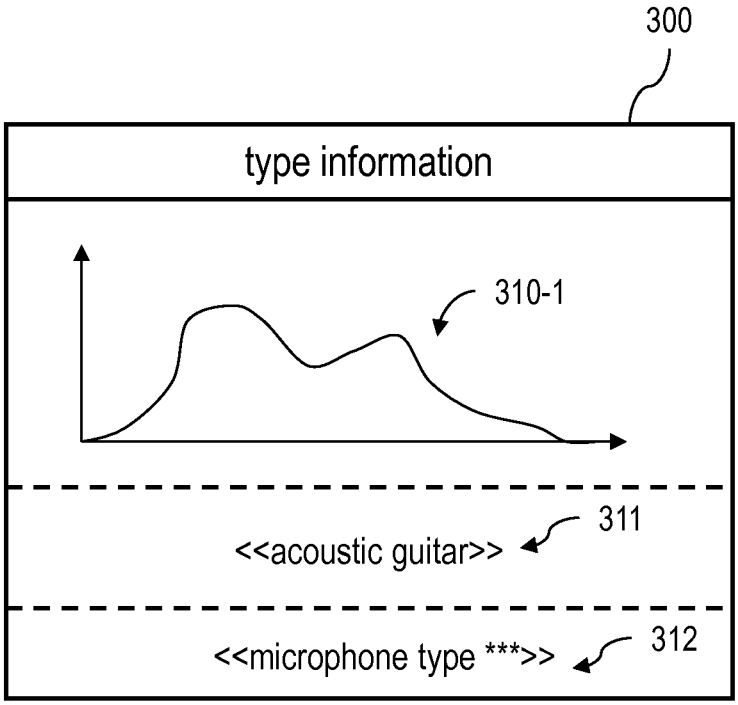
FIG. 3A schematically illustrates type information relating to audio content properties of an audio signal.

This type information 300 is depicted in FIG. 3A and relates to audio content properties of the audio signal 200-1. In the particular scenario discussed with respect to FIG. 3A, the type information 300 includes a characterization of a sound spectrum 310-1 of the received audio signal 200-1. For example, this characterization of the sound spectrum 310-1 can correspond to a power distribution of the different spectral components of the retrieved audio signal 200-1. In FIG. 3A, the type information 300 furthermore includes a classification of the originator 311 of the received audio signal, which in the presently discussed scenario specifies the electric guitar 210 (cf. FIG. 1). In FIG. 3A the type information 300 furthermore includes an identification of the audio source 312 which in the presently discussed scenario identifies the particular microphone 220 (cf. FIG. 1).

It should be understood that in various scenarios the type of information 300 may include the information as depicted in the embodiment of FIG. 3A, further information, or only parts of the information as depicted in FIG. 3A. In particular, in various embodiments the type information 300 may include a single piece of information or a plurality of information. The data format and/or content type of the data information 300 is not particularly limited.

There are different possibilities of how the type information 300 is established. For example, it may be possible that the sound spectrum 310-1 of the audio signal 200-1 is characterized and that depending on the characterizing of the sound spectrum 310-1 the type information 300 is established. For example, the characterizing of the sound spectrum 310-1 can be done by the processor 111. However, it would also be possible to send the audio signal 200-1 or parts thereof to a remote server via the interface 112 and execute the characterizing of the sound spectrum 310-1 at the remote server. Once the characterization of the sound spectrum 310-1 of the received audio signal 200-1 is obtained, it is possible to compare the latter with previously determined characterization of sound spectra of previously received audio signals. For example, if a large degree of correlation between the determined characterization of the sound spectrum 310-1 of the received audio signal 200-1 and the previously determined characterization of the sound spectrum of a previously received audio signal is obtained, it may be assumed that these two characterizations match. Then the type information 300 of the received audio signal 200-1 can be determined in dependence of said comparing, e.g. by re-using type information 300 provided for the matching previously received audio signal. When the characterizations of the sound spectra of two audio signals match, it may be possible to assume that the audio content of the two matching audio signals is the same.

Turning back to scenario discussed with respect to FIG. 2, once the type information 300 is established, processing properties may be retrieved for processing of the audio signal 200-1 fed to the audio channel 120-3. In particular, by retrieving the processing properties for the audio signal 200-1 in dependence of the type information 300 established for the audio signal, the processing parameters may be well suited for processing of the particular audio content of the audio signal 200-1. In the presently discussed scenario, this means that settings such as volume, equalizer, echo etc. are suited for processing the sound signals of the electric guitar 210.

Figure 3B:
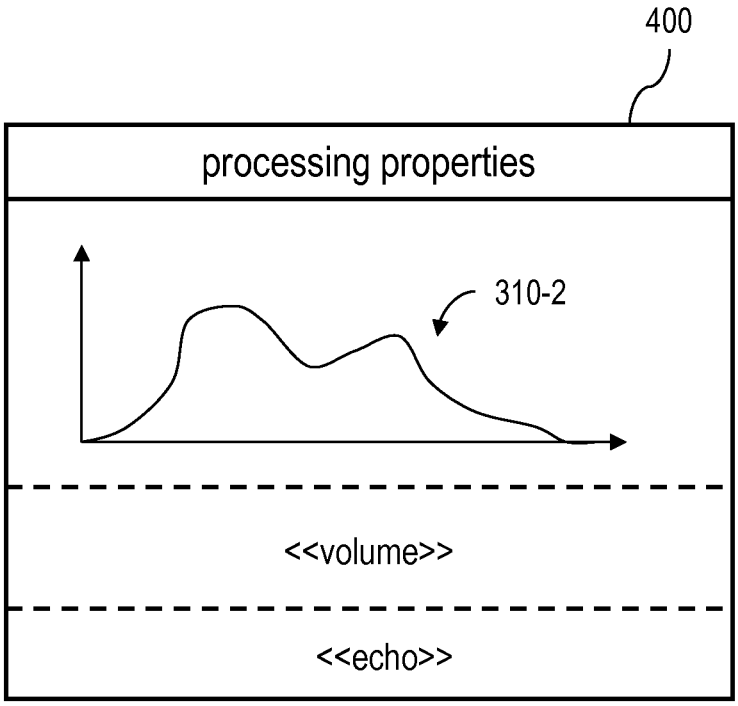
FIG. 3B schematically illustrates processing properties specifying audio effects and/or audio mixing applied to the audio signal when processing the audio signal.

In FIG. 3B, processing properties 400 are shown. Processing properties 400 include equalizer settings 310-2, which define a gain factor for different frequencies. Furthermore, the processing properties 400 include volume settings and echo settings. Based on such processing properties 400, the processor 111 can process the audio signal 200-1 to obtain the processed audio signal 200-2. In addition to the processing properties 400, the processor 111 can rely on settings of the user interface 114 of the channel 120-3 in order to process the audio signal 200-1. If motorized user interfaces 114 are present, they may be set according to the retrieved processing properties 400. In various scenarios, the processing properties 400 may serve as a base line of the processing while the processing is further defined by the settings and the user interfaces 114.

Turning back to FIG. 2, once the type information 300 has been established, it is also possible to display a corresponding label on the display 115 of the respective audio channel 120-3. For example, in the scenario in FIG. 2, the display 115 of the audio channel 120-3 could be configured to display "AcGtr".

In the scenario of FIG. 2, the audio inputs 110-1 are arranged in close vicinity of the respective user interface 114. Because of this close vicinity between the user interfaces 114 and the respective audio inputs 110-1, an allocation of the user interfaces 114 to a specific one of the audio inputs 110-1 may be predefined. However, in various scenarios it may be possible that this allocation of user interfaces 114 with respect to audio inputs 110-1 can be freely set, a process sometimes referred to as patching. For example, in such scenarios, it may be possible to allocate at least one of the user interfaces 114 for processing the received audio signal 200-1 in response to the retrieving of the processing properties 400. Along with this allocation of a given one of the user interfaces 114, the respective display 115 may be configured to display a respective label.

There may be scenarios where it in not possible or only possible to a limited degree to establish the type information 300 in a fully automatic manner. In such a scenario it may be possible to alternatively or in addition to techniques as discussed above with respect to said establishing detect a speech input of a user via a microphone 114*c*. In the scenario of FIG. 2, the microphone 114*c* is provided as an integrated element of the audio mixing console 100. However, in general the microphone 114*c* can be an external unit. Based on the detected speech input of the user, it may be possible to recognize a user command from the speech input using speech recognition techniques and establish the type information 300 on the recognized user command. This may allow to more precisely establish the type information 300. For example, a user in the scenario of FIG. 1 may articulate "acoustic guitar" which is then recognized as the respective user command and translated into the type information 300 as discussed previously with respect to FIG. 3A.

Figure 3C:
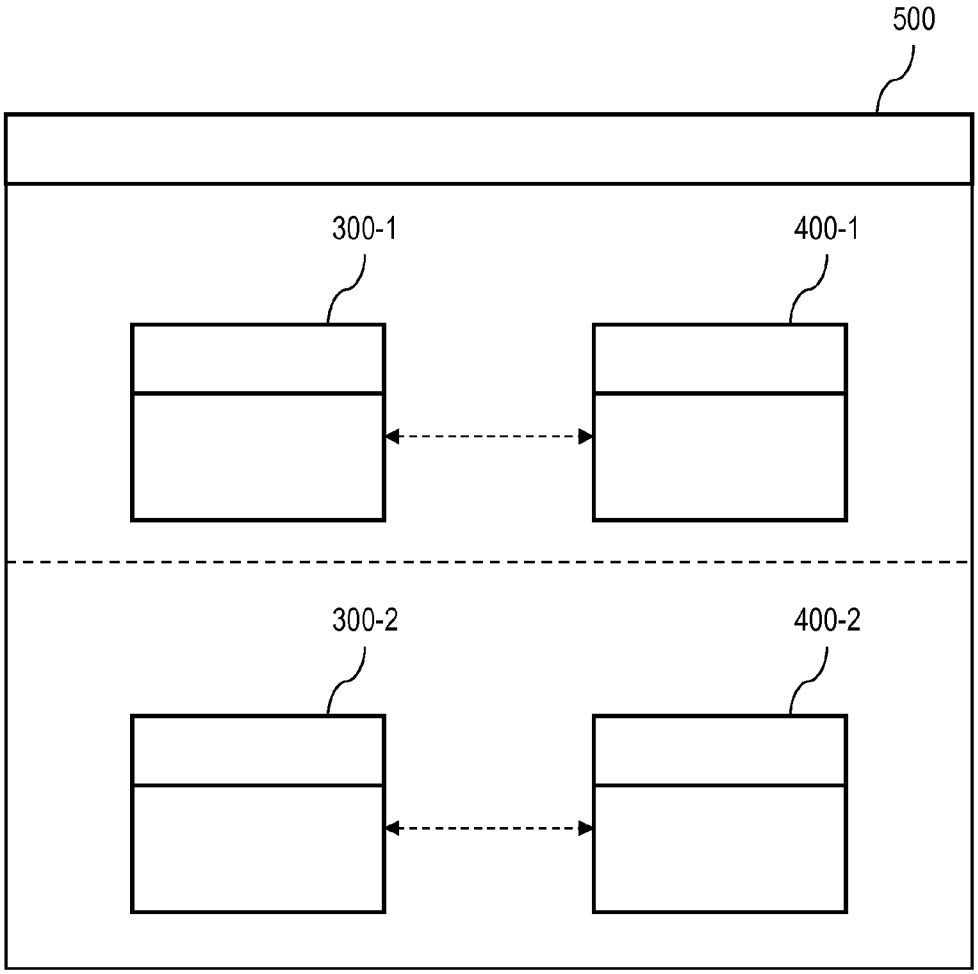
FIG. 3C schematically illustrates a database of processing properties, the database associating type information with processing properties.

Turning to FIG. 3C, the processing properties 400 for different audio contents may be stored in a database 500. Different structures and formats of the database 500 are possible. In general, the database 500 comprises some sort of association (as indicated by the dashed horizontal arrow in FIG. 3C) between one or more type information 300-1, 300-2 and a given processing property 400-1, 400-2. This allows to retrieve the processing property 400-1, 400-2 once the type information 300-1, 300-2 is established.

In various scenarios the database 500 is generated using techniques as discussed above. In particular, once processing properties 400 are determined, for example, by manual user input via the user interface 114, the associated type information 300 may be established using the techniques discussed herein. Automatically or upon user input, the type information 300 and the determined processing properties 400 may be stored in the database 500 in an associated manner. Such data 300, 400 may be referred to as historic user data, because it is obtained from operation of the audio mixing console 100 by the user Yet, alternatively or additionally to historic user data, the database 500 may store processing properties 400-1, 400-2 and type information 300-1, 300-2 which is predetermined reference data, e.g. as obtained from a third party. For example, this may allow for users with little or no experience in the operating of the audio mixing console 100 to automatically obtain well-suited processing properties 400 for said processing with no or only little user interaction.

In view of FIG. 3C, it is appreciated that the type information 300 may alone or in combination with further information comprise a link to previously used processing properties 400, (e.g., stored in the database 500). Additionally or alternatively, the type information 300 may include a link to reference audio content properties, which may be associated with default processing properties 400. Alternatively or additionally, the type information 300 may comprise a link to a previously received audio signal, which may be associated with a previously used processing property 400 stored in the data base 500.

Once the type information 300 is established, it is possible to match the established type information 300 with the type information 300-1, 300-2 stored in the database 500. If a sufficient degree of correlation between the established type information 300 and the type information 300-1, 300-1, which is stored in the database 500, is found, the thus matched type information provides an association with a particular processing property 400-1, 400-2 stored in the database 500. This processing property 400-1, 400-2 may be retrieved from the database and used as the processing properties for the audio signal.

Figure 4:
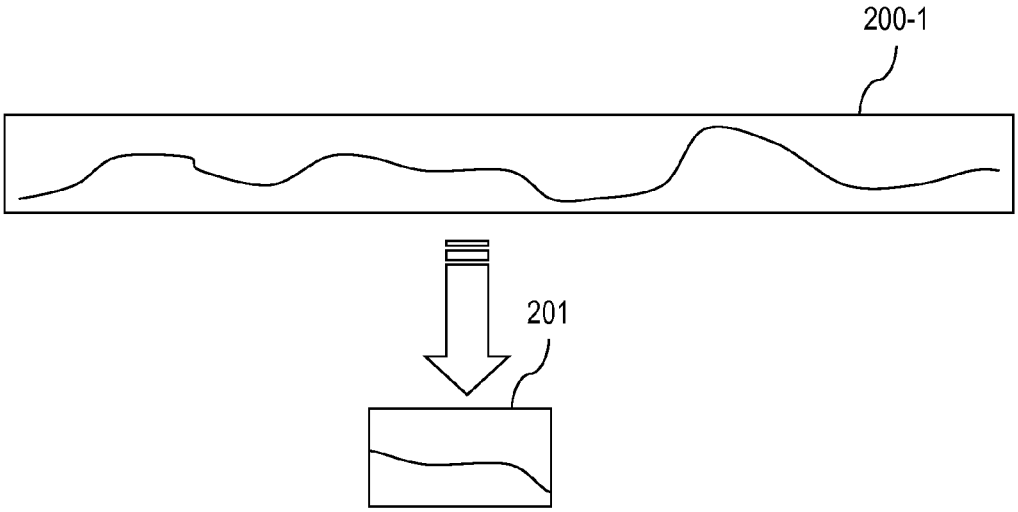
FIG. 4 illustrates extracting tracks from the audio signal.

In FIG. 4 it is illustrated how a track 201 is extracted from the audio signal 200-1. The track 201 is a characteristic fingerprint of the audio signal 200-1. The track 201 only comprises a fraction or part of the entire audio signal 200-1.

Figure 5:
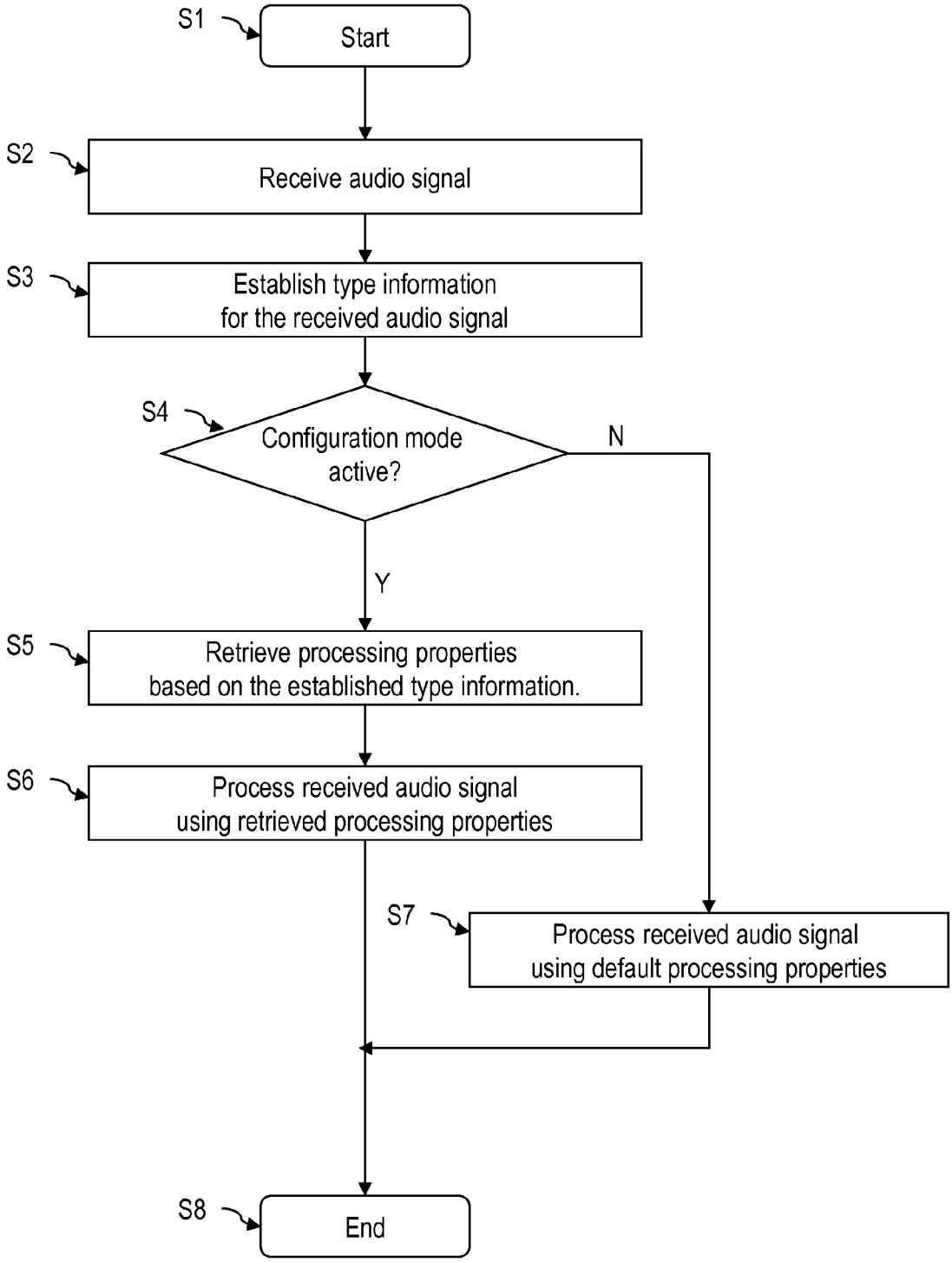
FIG. 5 is a flowchart of a method of retrieving processing properties according to various embodiments of the present invention.

In FIG. 5, a flowchart of a method of retrieving the processing properties 400 is illustrated.

The method starts in step S1. In step S2, the audio signal 200-1 is received via the audio input 110-1. In step S3, the type information 300 is established for the received audio signal 200-1.

Figure 6A:
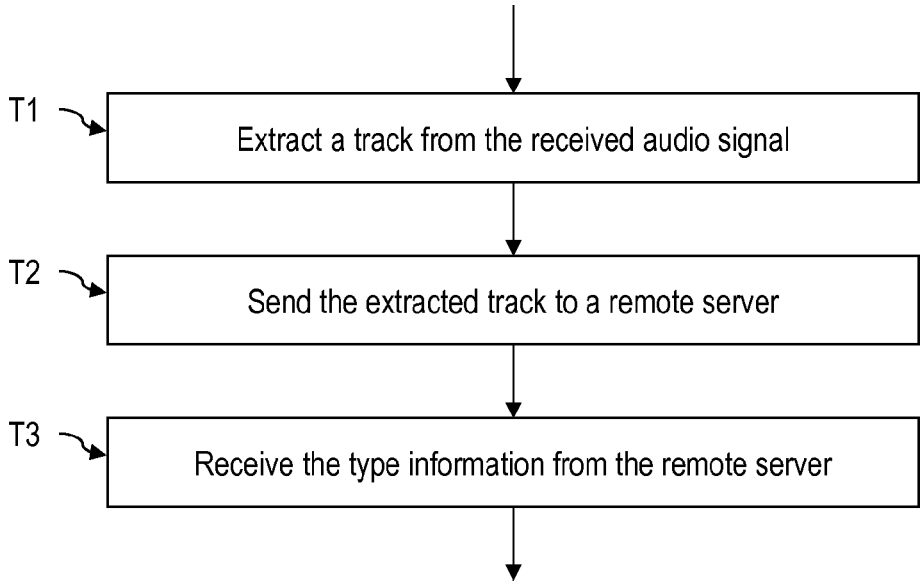
FIG. 6A is a flowchart illustrating further details of the flowchart of FIG. 5.

Turning to FIG. 6A, a first scenario of establishing the type information 300 is illustrated with a further flowchart. For this, a track 201 is extracted from the received audio signal 200-1 and sent to a remote server, for example, via the interface 112 (step T2). In step T3, the established type information 300 is received from the remote server, for example, again via the interface 112. In such a scenario, most of the logic of the establishing of the type information 300 resides at the remote server.

Figure 6B:
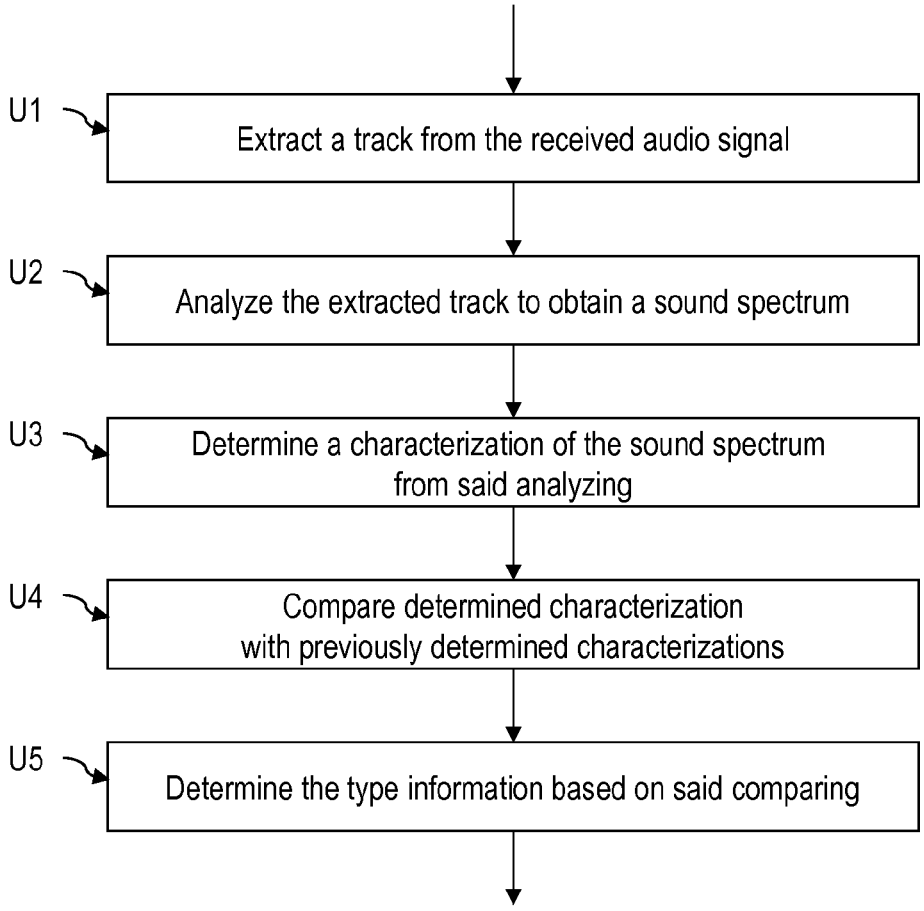
FIG. 6B is a flowchart illustrating further details of the flowchart of FIG. 5.

A further scenario of establishing of the type information 300 is illustrated in the flowchart of FIG. 6B. In step U1, again a track 201 is extracted from the received audio signal 200-1. The extracted track 201 is analyzed to obtain a sound spectrum 310-1, for example, using the processor 111 of the audio mixing console 100. A characterization of the sound spectrum 310-1 is determined from the analyzing (step U3), for example, again relying on the processor 111. The characterization of the sound spectrum 310-1 can include values which describe key features of the sound spectrum 310-1 of the received audio signal 200-1.

In step U4, the determined characterization of the sound spectrum 310-1, (i.e., the result of step U3, is compared to previously determined characterizations. If in step U4 a well-matching previously determined characterization is found, the type information can be determined based on type information of the matched previously determined characterization (step U5).

As can be seen from the above, the establishing of the type information 300 is not particularly limited—neither with respect to the kind of techniques used for said establishing, nor with respect to a distribution of logic between internal and external elements used for said establishing.

Turning back to FIG. 5, once in step S3 the type information 300 has been established, the method commences with step S4. In step S4, it is checked whether configuration mode is active. The configuration mode is activated for example upon user input, or at a predetermined repetition time, for example, every 10 seconds or so, or if it is detected that the established type information has significantly changed between step S3 and a previously established type information.

For example, the configuration mode may be activated by a user action received via a user interface. For example, the configuration mode can be activated by pushing and/or keeping pushed a dedicated button 114*b* (cf. FIG. 2).

If the configuration mode is not active, in step S7 the received audio signal 200-1 is processed using default processing properties. Then is step S8 the method ends. However, if in step S4 the configuration mode is active, in step S5 the processing properties 400 are retrieved based on the established type information 300 from the database 500. In step S5, the established type information 300 may be matched with type information provided in the database 500 and for a well-matching type information stored in the database, the corresponding processing properties 400 may be retrieved is step S5.

In step S6, the received audio signal 200-1 is processed using the retrieved processing properties 400 of step S5. Then the method ends in step S8.

Figure 7:
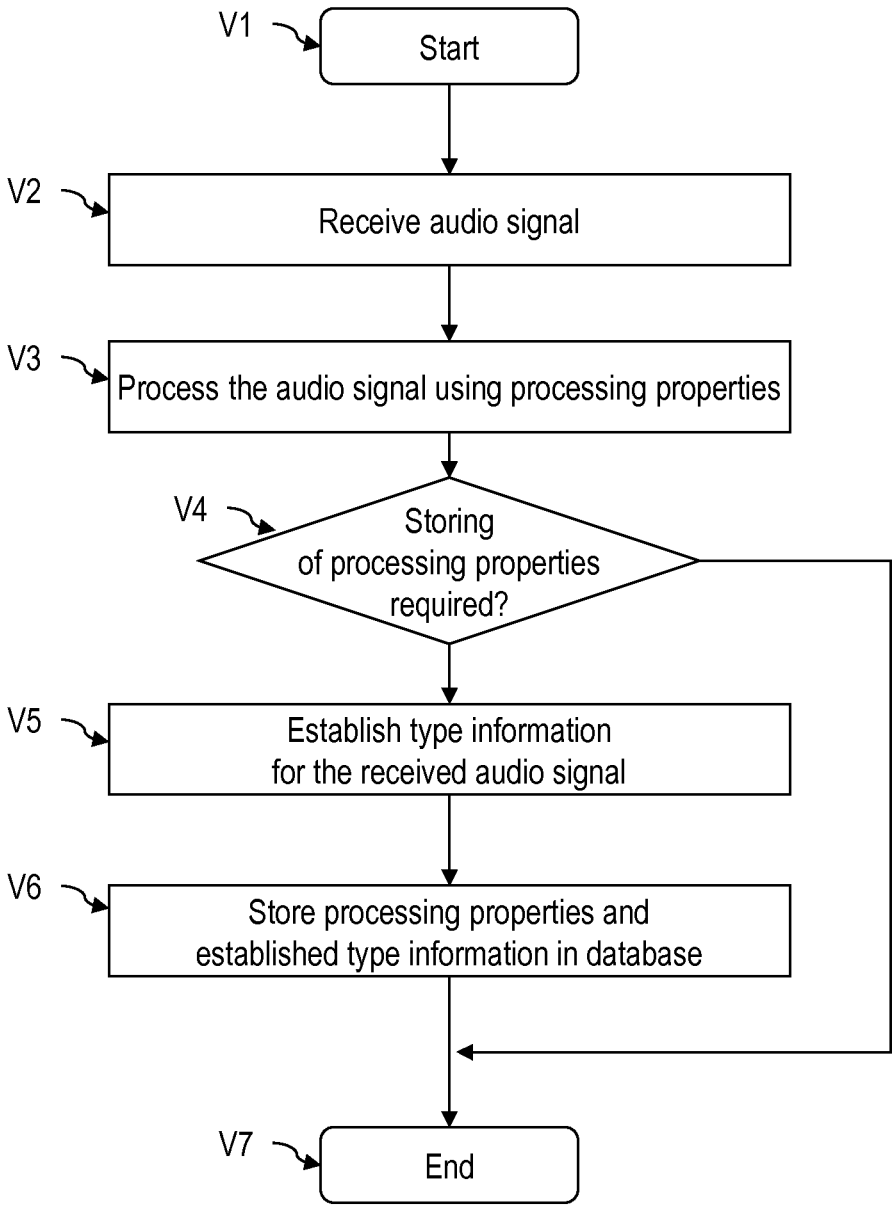
FIG. 7 is a flowchart of a method of generating a database of processing properties according to various embodiments of the present invention.

In FIG. 7, a flowchart of a method of generating the database 500 of processing properties 400 is depicted. The method starts in step V1. In step V2, the audio signal 200-1 is received. In step V3, the audio signal 200-1 is processed using processing properties 400. For example, the processing properties 400 of step V3 may depend on a particular setting of the user interface 114. In step V4 it is checked whether the processing properties 400 of step V3 are required to be stored. If this is not the case, the method ends in step V7. Otherwise, in step V5 type information 300 is established for the received audio signal 200-1. Step V5 corresponds to step S3 as previously discussed with respect to FIG. 5, 6A, 6B.

In step V6, the processing properties 400 and the established type information 300 are stored in the database 500. The method ends in step V7.

As can be seen from the above, techniques are provided which allow to automatically or semi-automatically retrieve processing properties which are used when processing an audio signal input to an audio processing system. Various favorable effects may be achieved with such techniques. For example, if a small band plays regularly together at venues such as bars, music clubs, etc. and they rehearse in a garage or a hired rehearsal rooms, with a current state of the art system, each time the audio mixing console is moved it would be necessary to physically reconnect the same instruments or sound sources to the same connectors on the audio mixing console. This is to ensure that the previous processing properties are reapplied without having to re-patch, i.e. re-route the audio inputs 110-1 to different audio channels 120-1, 120-2, 120-3 and/or interfaces 114. By techniques as described herein, this process could be alleviated by recognizing a sound of a given type, i.e. established type information relating to the audio content of the audio signal 200-1 at an audio input 110-1 and to use the type information 300 to retrieve the correct processing properties 400 from the database 500.

Another application would be a scenario where the audio mixing console 100 is used in a very basic sound reinforcement system, e.g. announcements in large gatherings such as a college sport day or a solo artist performance. In such applications, an incorrect patching of audio inputs 110-1 and audio channels 120-1, 120-2, 120-3 into user interfaces 114 is likely to be a secondary problem as there would be few audio sources 220 to consider. However, techniques as described herein can allow to automatically detect changes in the established type information 300 and change the processing parameters 400 used for said processing of the audio signal 200-1 correspondingly. A change in the audio content of the audio signal 200-1 may occur due to changing circumstances, for example, a change between a male and female announcer or the artists changing the guitars they are playing. The techniques discussed herein allow to optimize a sound experience and/or recall favorite processing properties 400 for a given instrument or originator 210.

Although the invention has been shown and described with respect to certain preferred embodiments, equivalents and modifications will occur to others skilled in the art upon the reading and understanding of the specification. The present invention includes all such equivalents and modifications and is limited only by the scope of the appended claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of retrieving processing properties for processing of an audio signal in an audio processing system, wherein the processing properties specify audio effects and/or audio mixing applied to the audio signal when processing the audio signal, the method comprises:

receiving the audio signal, at an audio input of the audio processing system;

establishing type information for the received audio signal, wherein the type information relates to audio content properties of the audio signal; and depending on the established type information, retrieving the processing properties for the audio signal from a database of processing properties, wherein the database associates type information with processing properties, and wherein the established type information includes at least one of a link to a previously received audio signal and a link to previously used processing properties.

2. The method of claim 1, wherein establishing of the type information depends on characterizing a sound spectrum of the received audio signal.

3. The method of claim 1, wherein establishing of the type information comprises:

determining a characterization of a sound spectrum of the received audio signal at a processor of the audio processing system, comparing the determined characterization of the sound spectrum with previously determined characterizations of sound spectra of previously received audio signals, in dependence of comparing the determined characterization of the sound spectrum with the previously determined characterizations of the sound spectra, determining the type information.

4. The method of claim 1, wherein the established type information further includes at least one of the following:

a classification of an originator of the received audio signal;

an identification of an audio source of the received audio signal;

a link to reference audio content properties; and a characterization of a sound spectrum of the received audio signal.

5. The method of claim 1, wherein establishing of the type information comprises:

extracting at least one track from the received audio signal, sending the extracted track, via an interface, to a remote server, the remote server being configured to characterize a sound spectrum of the track and to determine the type information in dependence of the characterized sound spectrum, and receiving the type information via the interface from the remote server.

6. The method of claim 1, wherein retrieving of the processing properties includes:

matching the established type information with a matched type information included in a set of previously determined type information, and for the matched type information, retrieving from the database associated processing properties as the processing properties for the audio signal.

7. The method of claim 6, wherein the set of previously determined type information comprises type information relating to audio signals previously received via an interface of the audio processing system and/or predetermined reference type information.

8. The method of claim 1, further comprising:

detecting a speech input of a user, recognizing a user command from the speech input using speech recognition techniques, wherein establishing of the type information depends on the recognized user command.

9. The method of claim 1, further comprising:

allocating at least one user interface of a plurality of user interfaces of the audio processing system for processing of the received audio signal, in response to said retrieving of the processing properties, and processing the received audio signal using the retrieved processing properties and in dependence of a setting of the at least one allocated user interface to obtain a processed audio signal.

10. The method of claim 9, further comprising:

displaying a label corresponding to a determined type information on a display of the audio processing system displaying a label corresponding to the determined type information, wherein the display designates the allocated at least one user interface.

11. The method of claim 1, wherein retrieving of the processing properties is selectively executed if the audio processing system is operated in a configuration mode, wherein the configuration mode is activated upon at least one of the following:

a user input;

a predetermined repetition time; and detecting a change in the established type information during processing of the audio signal.

12. A method of generating a database of processing properties for processing of an audio signal in an audio processing system, wherein the processing properties specify audio effects and/or audio mixing applied to the audio signal when processing the audio signal, the method comprising:

receiving an audio signal, at an audio input of the audio processing system, and processing the audio signal using processing properties, wherein the processing properties depend on a setting of at least one user interface of the audio processing system, establishing type information for the received audio signal, wherein the type information relates to audio content properties of the audio signal, and storing the processing properties and the type information in the database, and wherein the established type information includes at least one of a link to a previously received audio signal and a link to previously used processing properties.

13. The method of claim 12, further comprising associating, at the database, type information with the processing properties.

14. An audio processing system, comprising:

an audio input configured to receive an audio signal, a processor configured to establish type information for the received audio signal, wherein the type information relates to audio content properties of the audio signal, wherein the processor is further configured to retrieve processing properties for the audio signal from a database of processing properties depending on the type information, wherein the database associates type information with the processing properties, wherein the processing properties specify audio effects and/or audio mixing applied to the audio signal when processing the audio signal in the audio processing system, and wherein the established type information includes at least one of a link to a previously received audio signal and a link to previously used processing properties.

15. The audio processing system of claim 14, wherein the processor is further configured to establish the type information based on characterizing a sound spectrum of the received audio signal.

16. The audio processing system of claim 14 wherein the established type information further includes at least one of the following:

a classification of an originator of the received audio signal;

an identification of an audio source of the received audio signal;

a link to reference audio content properties; and a characterization of a sound spectrum of the received audio signal.

17. The audio processing system of claim 14, further comprising an interface configured to send an extracted track from the received audio signal to a remote server, the remote server being configured to characterize a sound spectrum of the track and to determine the type information in dependence of a characterized sound spectrum.

18. The audio processing system of claim 17 wherein the interface is further configured to receive the type information from the remote server.

19. The audio processing system of claim 14 further comprising a display configured to display a label corresponding to a determined type information.

20. The audio processing system of claim 19 wherein the display is further configured to designate at least one allocated user interface.

* * * * *